US008025092B2

(12) United States Patent
Arvedi

(10) Patent No.: US 8,025,092 B2
(45) Date of Patent: Sep. 27, 2011

(54) PROCESS AND RELATED PLANT FOR PRODUCING STEEL STRIPS WITH SOLUTION OF CONTINUITY

(76) Inventor: Giovanni Arvedi, Cremona (IT)

( * ) Notice: Subject to any disclaimer, the term of this patent is extended or adjusted under 35 U.S.C. 154(b) by 546 days.

(21) Appl. No.: 12/102,493

(22) Filed: Apr. 14, 2008

(65) Prior Publication Data

US 2008/0223544 A1 Sep. 18, 2008

Related U.S. Application Data

(63) Continuation-in-part of application No. PCT/IT2005/000754, filed on Dec. 22, 2005.

(51) Int. Cl.
*B22D 11/126* (2006.01)
*B22D 11/14* (2006.01)

(52) U.S. Cl. ..... 164/460; 164/459; 164/471; 164/476

(58) Field of Classification Search ..... 164/459, 164/460, 471, 476; 29/527.6, 527.7
See application file for complete search history.

(56) References Cited

U.S. PATENT DOCUMENTS

| | | | | |
|---|---|---|---|---|
| 6,092,586 | A * | 7/2000 | Schonbeck | 164/476 |
| 7,343,961 | B2 * | 3/2008 | Arvedi | 164/452 |
| 7,832,460 | B2 * | 11/2010 | Arvedi | 164/455 |

FOREIGN PATENT DOCUMENTS

| | | | |
|---|---|---|---|
| DE | 196 39 298 | A | 3/1998 |
| DE | 102 16 141 | A | 10/2003 |
| EP | 0 625 383 | A | 11/1994 |
| WO | WO 2004026497 | A1 * | 4/2004 |

* cited by examiner

*Primary Examiner* — Jessica L Ward
*Assistant Examiner* — Kevin E Yoon
(74) *Attorney, Agent, or Firm* — Lucas & Mercanti, LLP

(57) ABSTRACT

A process for the manufacturing of steel strips with solution of continuity is described, comprising a continuous casting step for thin stabs with a high "mass flow", a shearing step and subsequent heating in furnace, followed by a multiple stand rolling step, wherein the average temperature of the product at the inlet of the rolling is higher than the surface temperature, which is equal to at least 1100° C., lower than that measured in the inner central area by about 100° C. A plant is also described for the accomplishment of such process, wherein at the inlet of a furnace (25; 35), possibly of the induction type, combined with a temperature maintaining tunnel (36) a shear (3) is provided for, cutting into pieces (24; 34) a slab (22; 32) coming from continuous casting (21; 31), wherein the distance between the outlet of said continuous casting and the inlet into the finishing rolling mill (29; 39) is not greater than 100 m.

1 Claim, 3 Drawing Sheets

PROCESS AND RELATED PLANT FOR PRODUCING STEEL STRIPS WITH SOLUTION OF CONTINUITY

CROSS-REFERENCE TO RELATED APPLICATIONS

This application is a continuation-in-part of PCT Application Ser. No. PCT/IT2005/000754 filed Dec. 22, 2005, the disclosure of which is incorporated herein by reference.

The present invention relates to a process and related plant for the manufacturing of steel strips.

Figure 1:
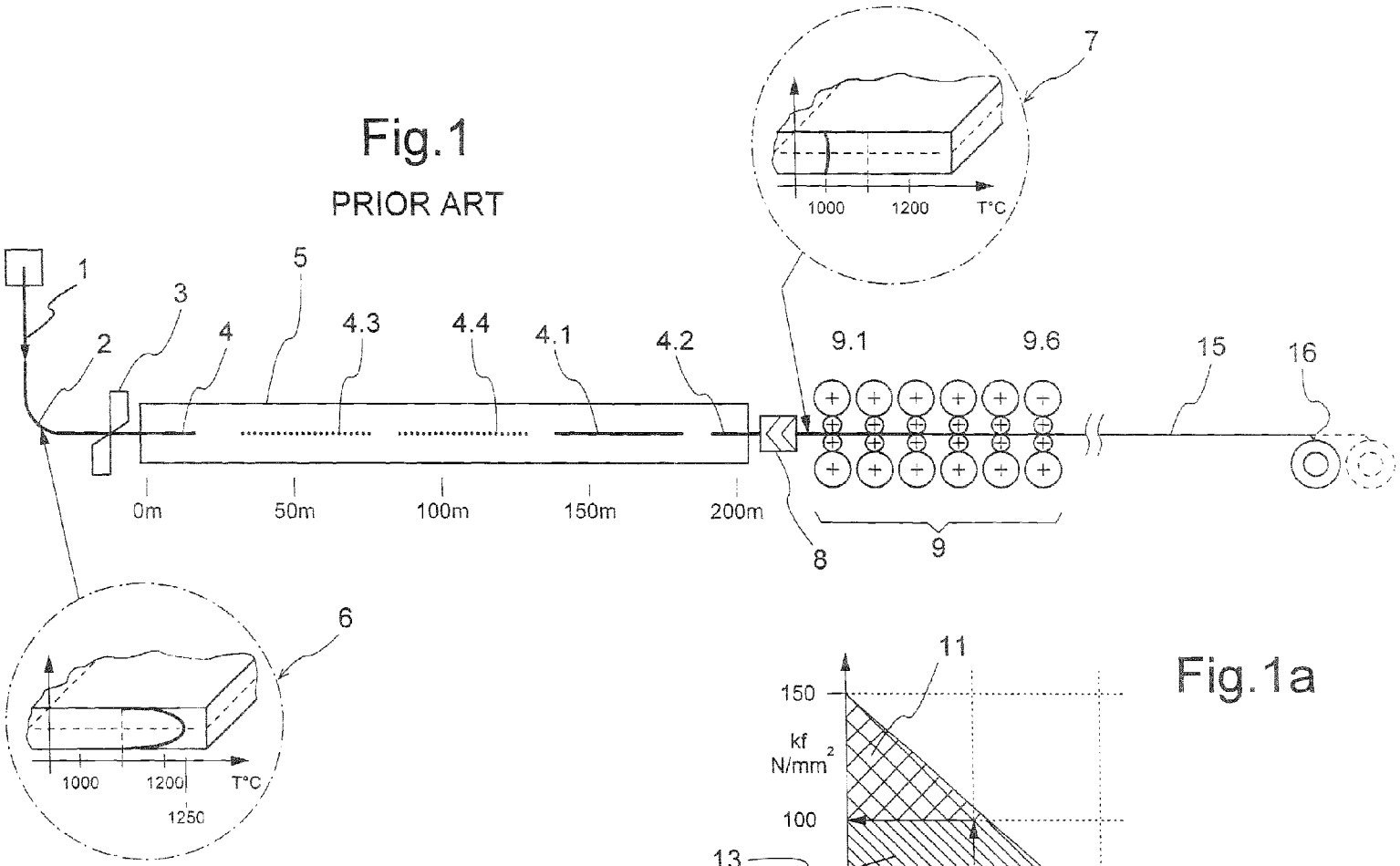
Fig.1 PRIOR ART

In the steel industry it is known the need, being however present in every industrial field, for using manufacturing methods involving lower investment and production costs. It is known as well that in the last years manufacturing methods based on the so-called "thin slab" technologies have had a remarkable development and success in this direction of cost reduction, above all under the energetic aspect. Three fundamental types of manufacturing processes and related plants, accomplishing such a technology, can be distinguished, namely a first type which does not provide for solution of continuity between the continuous casting step and the rolling one, a second type wherein said two steps are separated, thereby with a solution of continuity providing for the use of a Steckel rolling mill, and finally a third type, again with solution of continuity, as shown in FIG. 1, which represents the closest prior art to the present invention, as is accomplished, for example, in the so-called CSP plant of the American Company Nucor Steel in Crawlordsville, Ind. (US).

With reference to said FIG. 1, wherein the continuous casting machine is schematically represented as 1, a thin slab 2 is produced at the outlet thereof having thickness from 45 to 110 mm and a typical speed of 5 m/min. The slab is cut by means of a shear 3 at a typical length of 40 m, anyway depending on its thickness, on its width and on the weight of the desired final strip coil. The thin slab, so cut down into pieces 4, enters a tunnel furnace 5, whose purpose is to homogenize the temperature especially throughout the transverse cross-section, from the external surface to the core, then passes through a descaler 8 before entering the finishing rolling mill 9 comprising, in the example shown, six stands 9.1-9.6. After the rolling, from which it comes out on a cooling roller table 15, it goes to the final coiling by means of one or two reels 16 in order to form the desired coil.

It should be noted that the tunnel furnace 5 is characterized, as it is known, by a length of about 200 m and by a typical residence time of the slab inside thereof comprised between 20 and 40 min at a speed as indicated above. Of course, a continuous casting speed higher than 5 m/min requires a tunnel furnace length even greater than 200 m in order to heat the slab and make its temperature uniform. For example, with a speed of 7 m/min at the outlet of the continuous casting, the tunnel furnace should have a length of about 300 m if maintaining a residence time of the slab in the furnace greater than 40 min is not desired. By further increasing the casting speed, still for the same residence duration in the furnace, this should have an even greater length, hardly feasible both from a technical and an economical point of view.

Still with reference to FIG. 1, it shows three slabs 4, 4.1 and 4.2 inside the furnace 5, among which the first one is still connected to the continuous casting before being cut by the shear 3, the second one is free inside the furnace, ready to be rolled and the third one is already drawn by the finishing rolling mill 9 through the descaler 8. The virtual profiles of two additional slabs 4.3 and 4.4 are further represented by a dotted line, which might find a place inside the furnace 5 without having to stop the continuous casting in case of jammings in the rolling mill or of replacement operations of the rolls, if these problems can be solved in a time lower than 20 min.

The transverse temperature profile of the stab, immediately upstream of the first rolling stand, has been represented by the detail marked by reference number 7. The diagram of FIG. 1*a* further shows that a slab with a average temperature of 1000° C. at the inlet of the finishing rolling mill requires a pressure or "flow stress" Kf on the material equal to 100 N/mm$^2$, whereas a temperature of 800° C., in the case of low carbon steel, involves a pressure Kf of about 150 N/mm$^2$. As it can be noted in detail 7, the temperature profile of the slab at the inlet of the finishing rolling mill is substantially homogeneous, as shown by the slightly convex curve representing it from a minimum of about 990° C. at the ends, corresponding to the surface temperature, to a maximum of 1010° C. at the center zone, corresponding to the core of the slab, from which comes the previously indicated value of about 1000° C. for the average temperature.

In fact, according to the related prior art of this type of technology, it has been so far believed that the product at the outlet of the continuous casting 2, having a temperature profile as shown in the diagram of detail 6, relative to a slab cross-section at the inlet of the furnace 5, i.e. with a surface temperature of about 1100° C. and of about 1250° C. at the core (i.e. the apex of the diagram), should undergo a process of complete temperature homogenization. The trend has always been to homogenize such temperature as much as possible, especially throughout the cross-section of the slab, before entering the finishing rolling mill. In fact, it has been always thought that by making the temperature uniform between surface and core of the product, the advantage of a homogeneous fiber elongation could be obtained, in order to show the same strain resistance by substantially having the same temperature. On the basis of such a constant technical prejudice, it has been always tried to have a temperature difference being lower than 20° C. between surface and core of the product, as above indicated with reference to detail 7, in order to have a homogeneous fiber elongation, until now considered necessary for the achievement of a good quality of the final product.

On the other hand, as seen above, the temperature uniformity characteristic of the slabs does not allow building plants with the high casting speeds, which would be theoretically possible to achieve (up to values of 12 m/min due to the present technology development), and thereby with very high productivities, due to the inadmissible length the furnace should have.

Figure 1A:
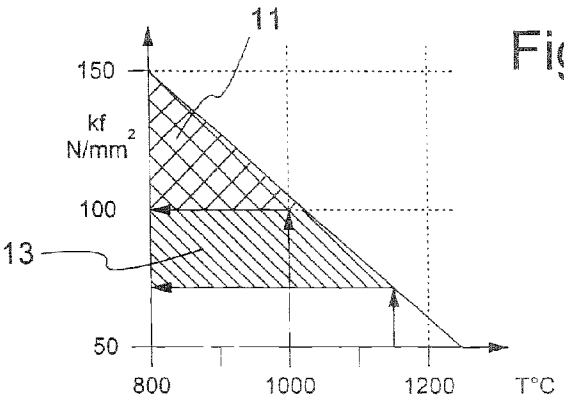

On the other hand it would be desirable to have furnaces of reduced length between continuous casting and rolling mill in order to obtain space saving and reduction of investments, resulting in a higher average temperature of the product, involving a lower total power of the stands for the same strip thickness, as highlighted in the diagram of FIG. 1*a* already mentioned.

In fact, thus overcoming a widespread prejudice of the prior art, it has been found that with a temperature in the middle of the cross-section of the slab being higher than 100-200° C. with respect to the surface temperature, maintained at about 1100° C., a lower rolling pressure Kf is required in order to obtain the same final thickness of the strip, because the average rolling temperature is increased, without otherwise worsening the product quality.

It has been also found that such temperature conditions are not prejudicial for the final rolling product quality, when the following conditions are met: the cast product shows a sufficiently high "mass flow" value (i.e. the amount of steel flowing in the time unit at the outlet of the continuous casting), with an outlet speed >5 m/min after having undergone a process of liquid core reduction or "soft reduction", in particular according to the teachings of EP 0603330 in the name of the same applicant, in order to guarantee the so-called "central sanity" characteristic of the cast slab and to have a higher temperature at the core, and thereby also a higher average temperature in the rolling step.

It is therefore an object of the present invention to provide a process for the manufacturing of steel strips with solution of continuity allowing the maximum possible reduction with the minimum separating strength and therefore requiring a reduced total power of the rolling stands with a consequent energy saving for a given strip thickness at the outlet of the rolling mill.

Another object of the present invention is to provide a process of the above-mentioned type being able to achieve, with a limited furnace length, very high productivities as a consequence of a high casting speed.

Figure 2:
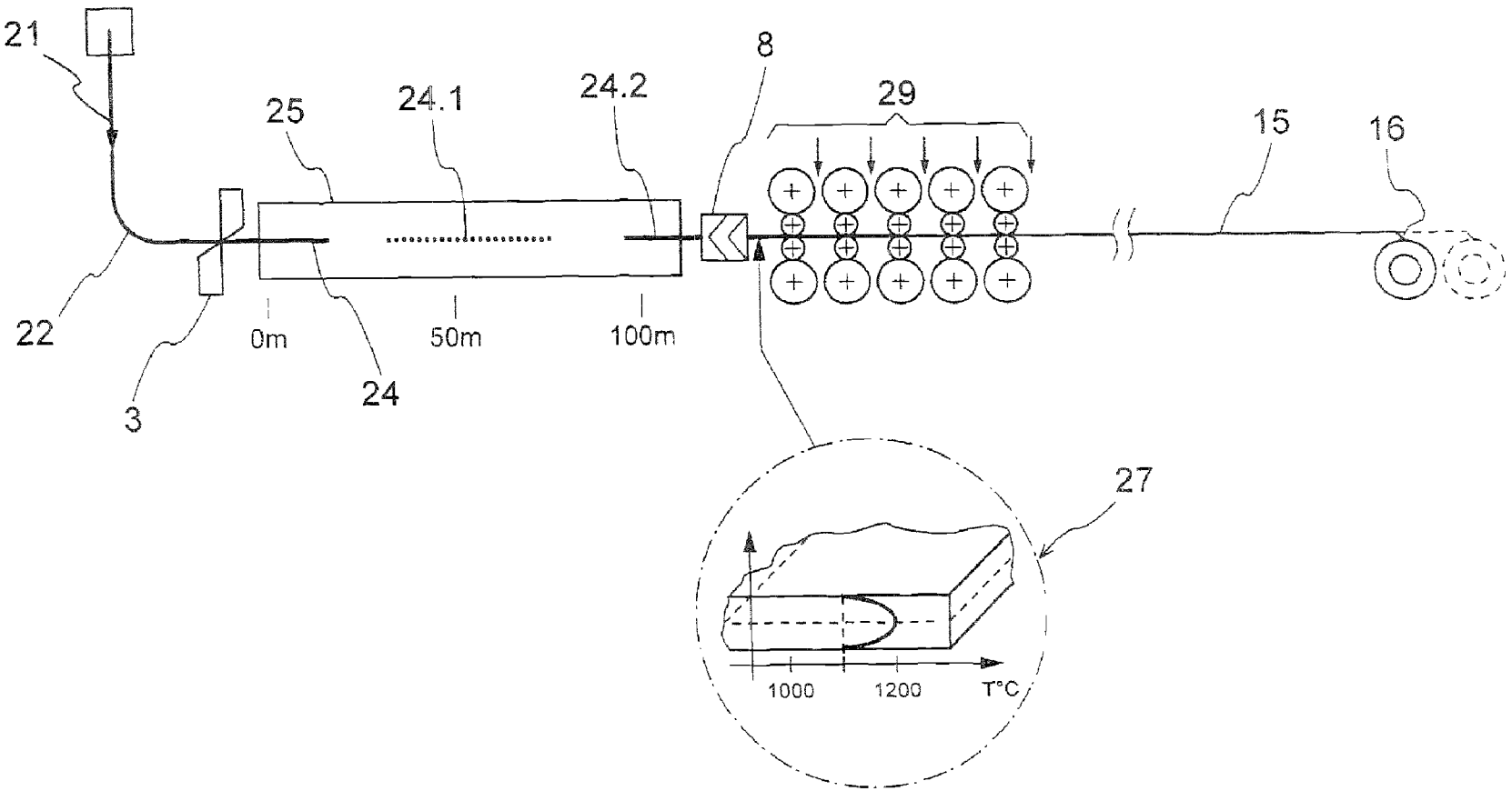
Figure 3:
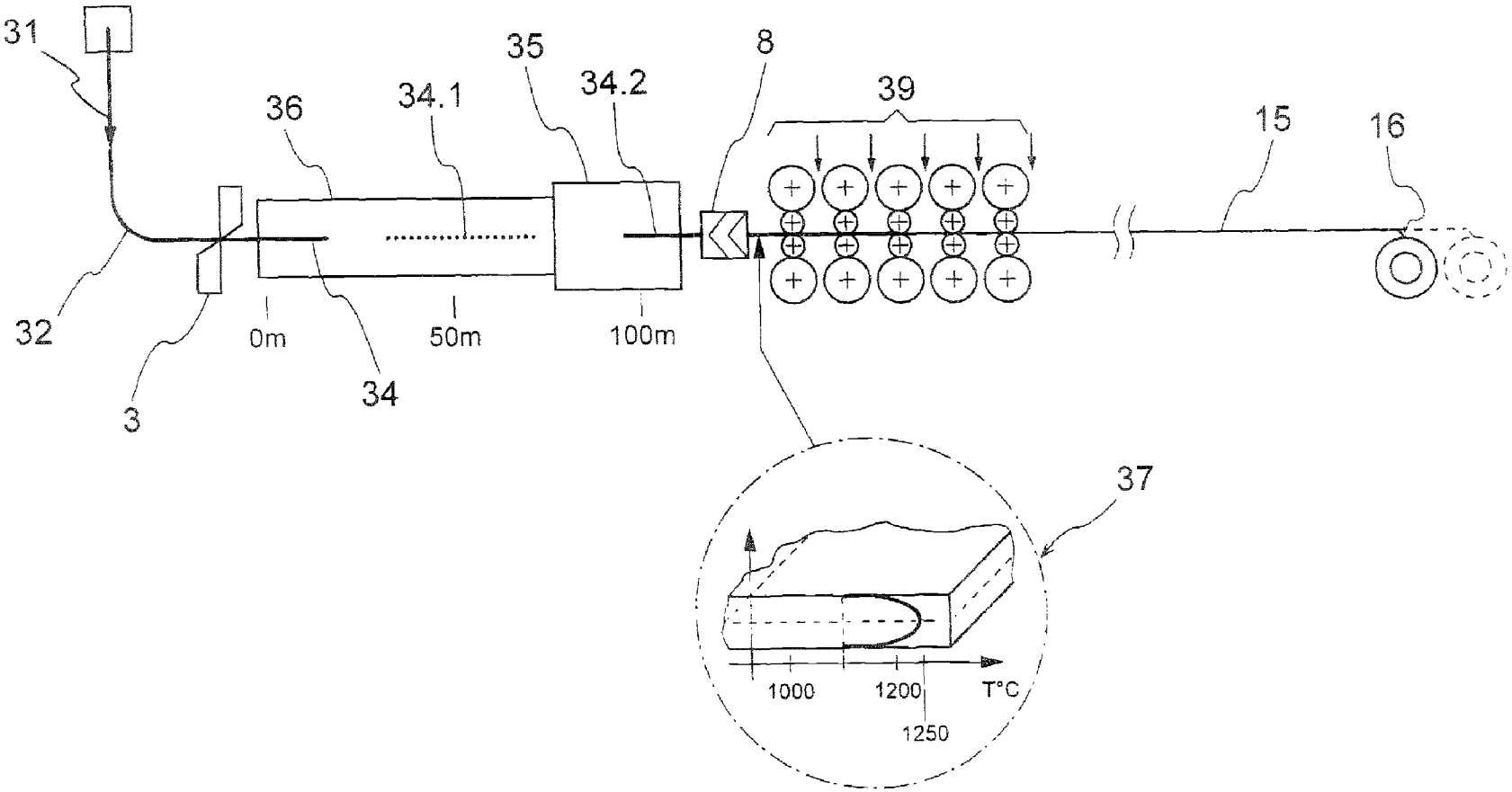

These and other objects are accomplished by a process having the characteristics mentioned in claim 1 and by a plant whose characteristics are recited in claim 3, while other advantages and characteristics of the present invention will become evident from the following detailed description of a preferred embodiment thereof, given by way of non-limiting example with reference to the annexed drawings wherein:

FIG. 1 schematically shows a plant for the manufacturing of steel strips from continuous casting, with solution of continuity, according to the prior art, as already described above;

FIG. 1*a* is a diagram showing the trend of the rolling pressure required as a function of the average temperature of the material to be rolled;

FIG. 2 shows a schematic view of a plant according to the present invention, similar to that of FIG. 1; and FIG. 3 shows a schematical view of a variant of plant according to the present invention, comprising an induction furnace.

With reference to FIG. 2, an example of plant carrying out the process according to the present invention is schematically shown starting from a thin slab 22 at the outlet of a continuous casting zone schematically represented in its whole as 21 and comprising, as it is known, a mould, as well as possible suitable means to accomplish a liquid core reduction or "soft reduction". The thin slab 22 comes out from the continuous casting 21 with the same thickness and speed values already indicated for the slab 2 of the plant of FIG. 1 relating to the prior art, i.e. with a thickness between 45 and 110 mm, e.g. 60 mm, a speed equal to 5 m/min and a width equal to 1600 mm, that is to say with a high "mass flow" as defined above. The temperature profile in the zone upstream of the furnace 25 (here not shown) is still the one shown in detail 6 of FIG. 1, with a surface temperature of about 1100° C. and of about 1250° C. at the core (diagram apex).

The slab is still cut down in pieces, prior to any rolling, typically having a length of 40 m, by means of the shear 3, according to the weight of the final coil desired, and enters a traditional tunnel furnace 25 (gas heated), but being of a limited length, having the purpose of maintaining the thin slab 24 in temperature by heating the same. Therefrom it passes, through the descaler 8, into a finishing rolling mill 29 from which comes out, upon its rolling, on a roller table 15 in order to be coiled by means of one or two reels 16, as already seen according to FIG. 1.

Differing from the plant of FIG. 1, the tunnel furnace 25 here shows a length that must be as reduced as possible and anyway not greater than 100 m, so that the residence time of the thin slab inside thereof be as short as possible. This is for the purpose of maintaining a profile with a "triangular" trend at the outlet thereof, as indicated in detail 27, being characterized by a surface temperature of about 1100° C., a temperature at the slab core of about 1200° C. and a average temperature of about 1150° C. The resulting trend is thereby substantially less homogeneous than the profile shown in detail 7 of FIG. 1, for the same feeding speed.

Inside furnace 25 two slabs 24 and 24.2 are represented of which the first one is still connected to the continuous casting before being cut by shear 3 and the second one is already drawn by the finishing rolling mill 29 through the descaler 8, and thereby is already in the rolling step. The dotted line 24.1, intermediate between the two slabs, instead represents the space available for a further slab, serving as a "lung" in case of jamming of the rolling mill, if the slab thickness at the outlet and the weight of the coil desired allow to have slabs of length <30 m, given the above-mentioned limits of overall furnace length. Each slab, after the shear 3 cut, is accelerated and transferred to the central part of the furnace until it reaches the entering speed of the finishing rolling mill, equal to about 15-20 m/min, in order to reduce the residence time in the furnace itself as much as possible, which will be able to be even lower than 10 minutes instead of the 20-40 min foreseen for a plant according to the prior art shown in FIG. 1.

As previously stated, it should be noted that anyway the distance between the outlet from the continuous casting 21 and the finishing rolling mill 29 will not be greater than about 100 m, with the further consequent advantage of having a more compact plant requiring a reduced space also with high speeds at the outlet of the continuous casting. In such a way the average temperature of the product will be higher than the surface temperature, being higher of at least 100° C. at the core with respect to the external surface. From the diagram of FIG. 1*a* it is clear that a Kf value of about 70 $N/mm^2$ corresponds to a average temperature of 1150° C., instead of 100 $N/mm^2$ as it happens with the average temperature of 1000° C. resulting from the plant of FIG. 1.

It should be noted that, by using the above-mentioned higher temperature of the "mass flow", greater reductions can be achieved, in particular in the first rolling stands, allowing to obtain thinner thicknesses with the same or a lower number of stands with respect to the prior art. In FIG. 2, for example, the rolling mill stands 29 have been represented in a number of five against the six ones of the rolling mill 9 of FIG. 1.

FIG. 3 shows another embodiment of the present invention, wherein the tunnel furnace 25, typically gas heated, is substantially replaced by an induction furnace 35. In the prior art (see for example EP 0415987 in the name of the same applicant) induction furnaces have been used in order to heat a thin slab, previously rolled to a thickness of about 15 mm in a roughing rolling mill, and make it suitable for the subsequent finishing rolling step. As the slab core was anyway hotter than the surface, the working frequency of the furnace was generally chosen sufficiently high so that the depth of penetration of thermal energy, inversely proportional to frequency, were such to mainly heat the surface layer characterized by a lower temperature.

On the contrary, according to the present invention, the induction furnace 35 of FIG. 3 is used with a sufficiently low working frequency so that the heating action, being performed in a nearly homogeneous way throughout the whole transverse cross-section of the slab to the core, substantially maintains the same trend as at the inlet thereof until the end, such trend being shown by the diagram of detail 6 in FIG. 1. Thus, if at the inlet of furnace 35 the slab 34, to be cut by means of shear 3 froth slab 32 coming out from the continuous casting 31, has a surface temperature of 1100° C. and of 1250° C. at the core, at the outlet of said furnace it will be able to have also a surface temperature of 1150° C. or higher and of about 1250° C. at the core, not only maintaining a sensible temperature difference inside-outside, but also increasing the average temperature of the slab under rolling, with all the advantages previously shown with reference to FIG. 1*a*.

Before entering the induction furnace 35, the thin slab 32 coming from the continuous casting 31 passes anyway, after the shear 3, into a temperature maintaining and possible heating tunnel 36, which has the purpose of limiting the thermal losses.

It should be noted that the induction furnace 35, differently from what is shown in FIG. 3, could also be placed before said tunnel 36, in such a way to increase the slab temperature while this is still connected to the continuous casting, for the purpose of limiting its power dimensioning. After the cut by shear 3, the slab cut down piece 34 is accelerated, as already said for slab 24 with reference to FIG. 2, in order to reach the entering speed of the rolling mill 39, equal to about 15-20 m/min. The tunnel 36 comprising the roller tables between continuous casting and rolling mill, upstream and/or downstream of the furnace 35, is formed of insulating panels, which might be provided with gas burners and/or resistors in order to further reduce the heat losses. To sum up, given the lower length of an induction furnace with respect to a traditional one, it can be said that also in this case, taken into account tunnel 36, being of a reduced length with respect to furnace 25 of FIG. 2, the total distance between the outlet of the continuous casting and the rolling mill inlet is again not greater than 100 m.

Cooling systems or possibly intermediate heating systems, not shown in the drawing, can be provided for among the stands of the finishing rolling mill 29 or 39, being inserted between one stand and an other according to the rolling speed and to the steel type to be rolled.

Finally, the present invention can also be used in order to carry out processes and related plants with two casting lines supplying the same rolling mill 29 or 39.

The invention claimed is:

1. A process for the manufacturing of steel strips, comprising:

continuously casting thin slabs having thickness of between 45 and 110 mm and a high mass flow, which is defined as an amount of steel passing in a time unit at an outlet of the continuous casting, wherein liquid core reduction is performed during continuous casting of the slabs;

shearing the slabs directly following the continuous casting where the liquid core reduction has been performed and prior to any rolling;

heating the slabs;

rolling the slabs through a finishing rolling mill, which has multiple stands for rolling, wherein the heating is obtained, at least partially, by induction heating with a working frequency sufficiently low to bring the heating to a core of the slabs and to substantially maintain a same temperature difference between an inside and an outside of the slabs up to entry of the slabs into the finishing rolling mill, and whereby an average temperature in any transverse cross-section of the slabs is higher than a surface temperature of the slabs, the temperature being equal to or higher than about 1100° C., and at the core of the slabs, the temperature being at least 100° C. higher than the surface temperature.

* * * * *